US007044895B1

(12) United States Patent
Iglehart

(10) Patent No.: US 7,044,895 B1
(45) Date of Patent: May 16, 2006

(54) CORNER-BAG

(75) Inventor: Thomas Anthony Iglehart, Sunny Isles Beach, FL (US)

(73) Assignee: Thomas Iglehart

( * ) Notice: Subject to any disclaimer, the term of this patent is extended or adjusted under 35 U.S.C. 154(b) by 12 days.

(21) Appl. No.: 10/709,274

(22) Filed: Apr. 26, 2004

(51) Int. Cl.
*A63B 69/20* (2006.01)
*A63B 69/34* (2006.01)

(52) U.S. Cl. ..... 482/83; 482/87

(58) Field of Classification Search ..... 482/83–90; D21/787, 798
See application file for complete search history.

(56) References Cited

U.S. PATENT DOCUMENTS 1,049,835 A * 1/1913 Finney ..... 482/88
5,788,613 A * 8/1998 Grimaldi ..... 482/83
5,863,278 A * 1/1999 Chen ..... 482/83
5,902,217 A * 5/1999 Schechner et al. ..... 482/83
D440,269 S * 4/2001 Thomas ..... D21/787
6,220,992 B1 * 4/2001 Shafik ..... 482/83
6,251,051 B1 * 6/2001 Chen ..... 482/83
6,790,167 B1 * 9/2004 Carlin et al. ..... 482/90
2004/0097348 A1 * 5/2004 Laudenslager et al. ..... 482/86
2005/0164847 A1 * 7/2005 Giusti ..... 482/86

* cited by examiner

*Primary Examiner*—Jerome W. Donnelly
*Assistant Examiner*—Victor K. Hwang

(57) ABSTRACT

My invention relates to improvements in striking aids; and it is among the objects of the invention to provide a multifunction striking apparatus usable as a combination speed bag and/or striking apparatus. My invention also provides conversion features, mobile features, and the ability to fit against the inner or outer corner of a wall.

1 Claim, 23 Drawing Sheets

CORNER-BAG

CROSS REFERENCE TO RELATED APPLICATIONS

Not applicable.

BACKGROUND OF INVENTION

1. Field of the Invention

This invention relates generally to exercise devices, and more particularly to a device that is to be kicked or punched as a form of exercise.

2. Description of Related Art

A variety of kicking and punching aids currently exist in the art. These aids function primarily to provide a point of impact absorption for kicks and punches. A variety of configurations exist. Some are free standing with the aid of a supporting base. Others, commonly referred to as heavy bags, hang from a support structure. All are made for use in open areas. Some examples are the kicking and punching aids of Chen U.S. Pat. No. 6,251,051, the Chu U.S. Pat. No. 6,241,640 B1, the Thomas D440,269 S, the Cragg U.S. Pat. No. 6,348,028 B1, the Henry U.S. Pat. No. 6,302,831 B1, the Fotsis U.S. Pat. No. 6,234,940 B1, the Shafik U.S. Pat. No. 6,220,992 B1, the Ray U.S. Pat. No. 5,944,639, the D'Alto U.S. Pat. No. 5,941,801, the Schechner et al. U.S. Pat. No. 5,902,217, the Capach U.S. Pat. No. 5,897,466, the Kuo U.S. Pat. No. 6,106,443, the Nadorf et al. U.S. Pat. No. 6,027,435, and the Haselrig U.S. Pat. No. 6,432,027 B1.

Although the current kicking and punching aids adequately provide the function of impact absorption, the kicking and punching aids of the prior art don't; conform to fit a wall's outer or inner corners, possess the option of being hung or placed onto a stand, possess a means for compact mobile use; possess the ability to change in shape; possess the ability for hand held use. Accordingly, there is need in the art for a new kicking and punching aid which has a space efficient design and is substantially adaptable to multiple variations in its method of use.

SUMMARY OF INVENTION

In terms of broad inclusion, the kicking and punching aid of my invention comprises: a body unit; multiple striking surfaces; various vertical adjustment methods; multiple attachment means; the ability to in change shape; a free standing capability; a means for adjusting the weight; a means for compact mobile use; a means for handheld use. The invention is contoured to fit a wall's outer or inner corner. The invention's corner fitting design gives the user the ability to use it in areas that are very limited in space.

A primary objective is to provide an apparatus having advantages not taught by the prior art. The invention possesses other objects and features of advantage, some of which, with the foregoing, will be set forth in the following description of my invention, taken in conjunction with the accompanying drawings, which illustrate, by way of example, the principles of the invention. It is to be understood that I do not limit myself to this disclosed species of my invention, as I may adopt variant embodiments thereof.

DETAILED DESCRIPTION

Figure 1:
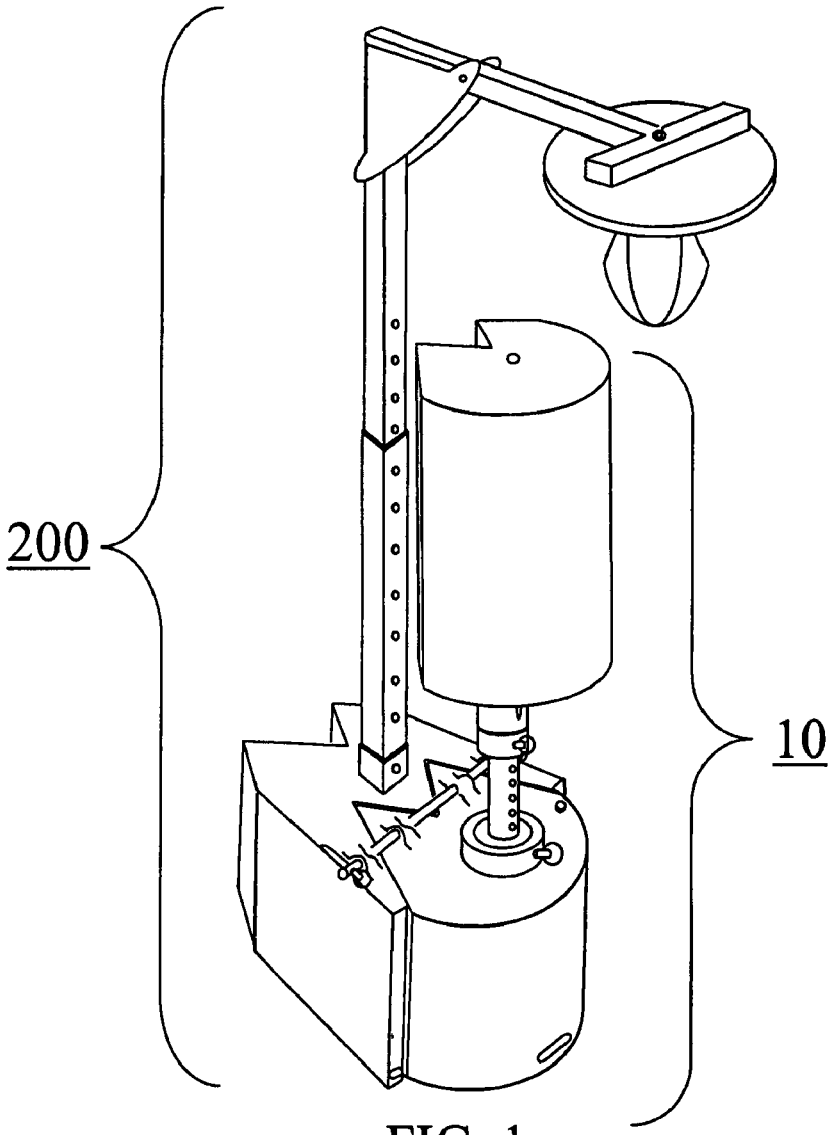
FIG. 1 is a perspective view of the training bag apparatus, constructed in accordance with the present invention, using the speed bag assembly in conjunction with the striking pad assembly.

Referring to the drawings in general and to FIG. 1 in particular, shown therein is a training bag apparatus, which includes a striking pad assembly 10 and a speed bag assembly 200.

Figure 4:
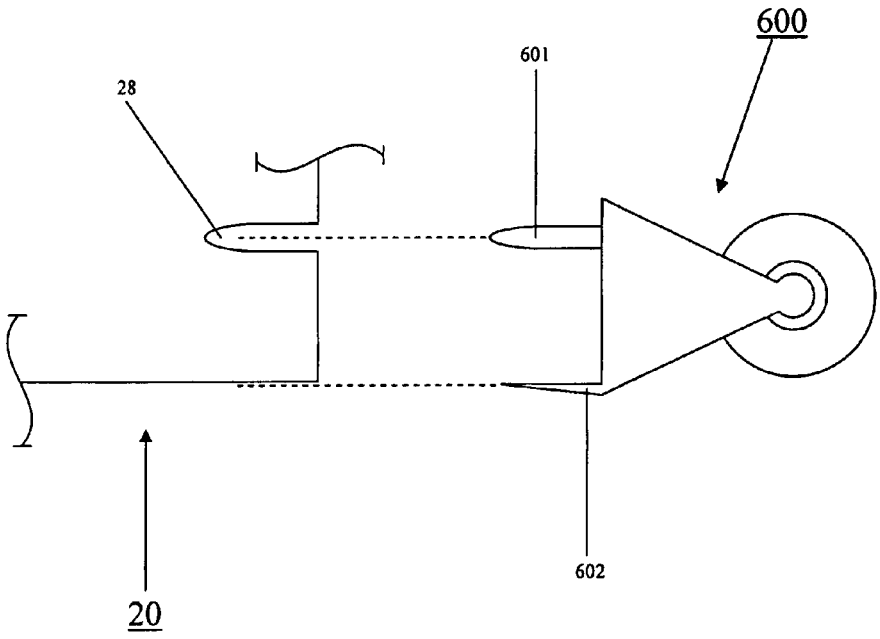
FIG. 4 is a side view of the wheel attachment of the striking pad assembly.

As best seen in FIGS. 2–7, a training bag apparatus in accordance with the present invention comprises a striking pad assembly 10, which includes a base 20 formed such that there exist angles 27 which allow it to conform to both the inner and outer corners of a wall. The base 20 includes a chamber 21 formed therein for receiving fluids and including a mouth 26 formed in the upper portion thereof and communicating with the chamber 21 of the base 20 for receiving the fluids, such as the water, any suitable liquid, or other particulate materials, such as sand, gravel, coated or uncoated metallic shot and the like, to give the punching aid stability. A cap 4 is detachably secured onto the mouth 22 of the base 20 for enclosing the chamber 21 of the base 20 and for confining the fluids within the base 20. The base 20 includes a coupler 24, extended upward therefrom and having an aperture 23 formed therein for threading a fastener or a pin 2. The base 20 may also be made to a solid structure having a suitable stability. The base 20 typically has 4 angles 27 to facilitate an inner and outer corner fitting form. However, it should be appreciated that the base 20 may be constructed in a wide variety of geometric shapes without departing from the scope and purpose of the present invention. A hole 25 is at the center of a socket 26 that is formed within the coupler 24 and chamber 21 of the base 20. The Socket 26 shares an aperture 23 with the coupler 24 formed therein for threading a fastener or a pin 2. The socket 26 acts to provide a point of flexibility for the striking pad assembly 10 and is preferably made of a flexible synthetic or rubber material wherein the hole 25 may be made to a size and diameter no less than that of the column 31. The middle lower front portion of the base 20 includes a slot 28 formed therein for receiving a wheel attachment 600. As best shown in FIG. 4, the wheel attachment 600 includes a bar 601 that is formed in such a way as to fit within the slot 28 of the base 20 while a brace 602 simultaneously rests against the bottom of the base 20 thus causing the wheel attachment to lock into place.

A support unit 30 includes a coupler 33 and column 31 to be secured vertically on top of a base 20. The coupler 33 includes a projection 36 extended inward of a hole 35 thereof for engaging into the groove 42 and lock slot 43 of the stud 41, and an aperture 34 formed therein for threading a fastener or a pin 2, such as a column 31 provided on the lower portion thereof, which includes apertures 32 formed therein for threading a fastener or a pin 2.

A column 40 is to be secured vertically on top of the support unit 30 via a coupler 33, such as a stud 41 provided on the lower portion of the column 40. The stud 41 includes one or more, preferably two, groove(s) 42 formed therein. The groove(s) 42 have an open lower end and are preferably vertical and have a lock slot 43 formed in the upper portion thereof. The stud 41 includes an aperture 47 formed therein for threading a fastener or a pin 2. The column 40 includes one or more longitudinal channels 44 formed therein and having one or more lock slots 45 communicating with the respective channels 44. A striking pad 50 includes a bore 51 formed therein for receiving the column 40 and includes one or more projections 52 extended inward of the bore 51 thereof for engaging into the channels 44 and/or the lock slots 45 of the column 40 and for setting the striking pad 50 to various heights. The striking pad 50 is preferably made of spongy or rubber materials for striking purposes, and is formed to include angles 54 which allow it to conform to inner and outer angled wall corners. A barrel 53 is preferably engaged in and secured in the inner portion of the striking pad 50 for defining the bore 51 of the striking pad 50 and is made of harder or stronger materials than that for the striking pad 50, such as plastic materials, and has the projections 52 extended therefrom. The projections 52 are also made of the stronger materials and thus have a suitable strength for engaging into the channels 44 and the lock slots 45 of the column 40 and for supporting the striking pad 50 on the column 40 at the required height. The barrel 53 and striking pad 50 shares a hole 55 that is provided as a passage for airflow or any necessary attachments. Two links 56 are located opposite each other on either side of the open end of the barrel 53 at the bottom end of the striking pad 50.

Figure 10:
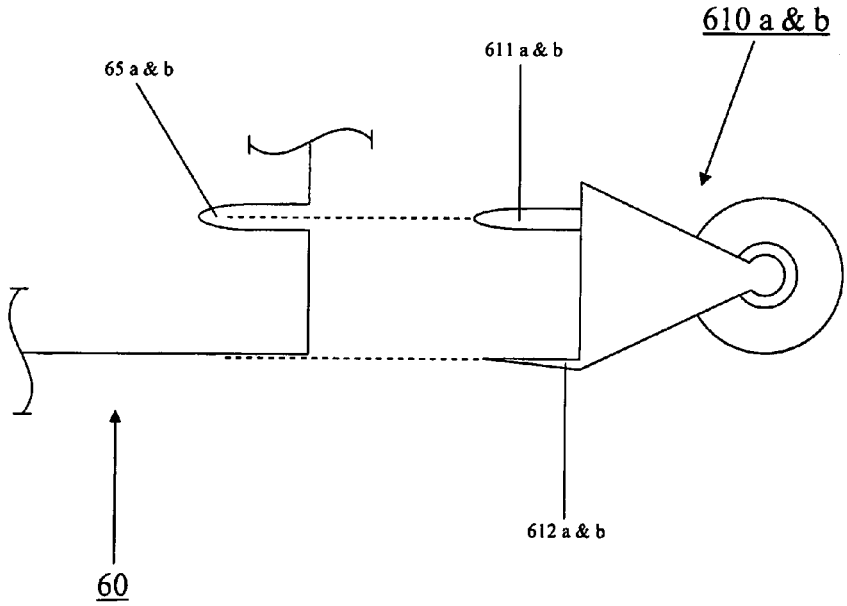
FIG. 10 is a side view of the wheel attachment of the speed bag assembly.
Figure 11:
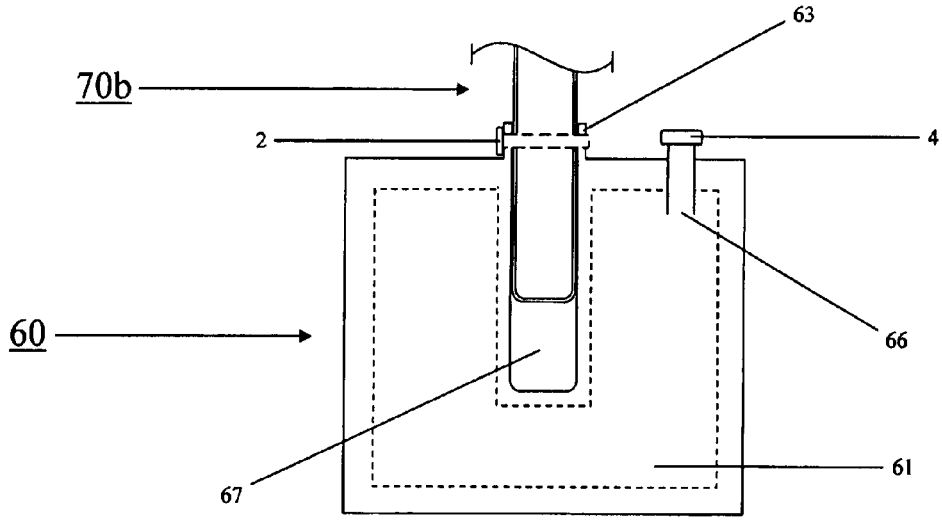
FIG. 11 is a sectional view of the base of the speed bag assembly.
Figure 12:
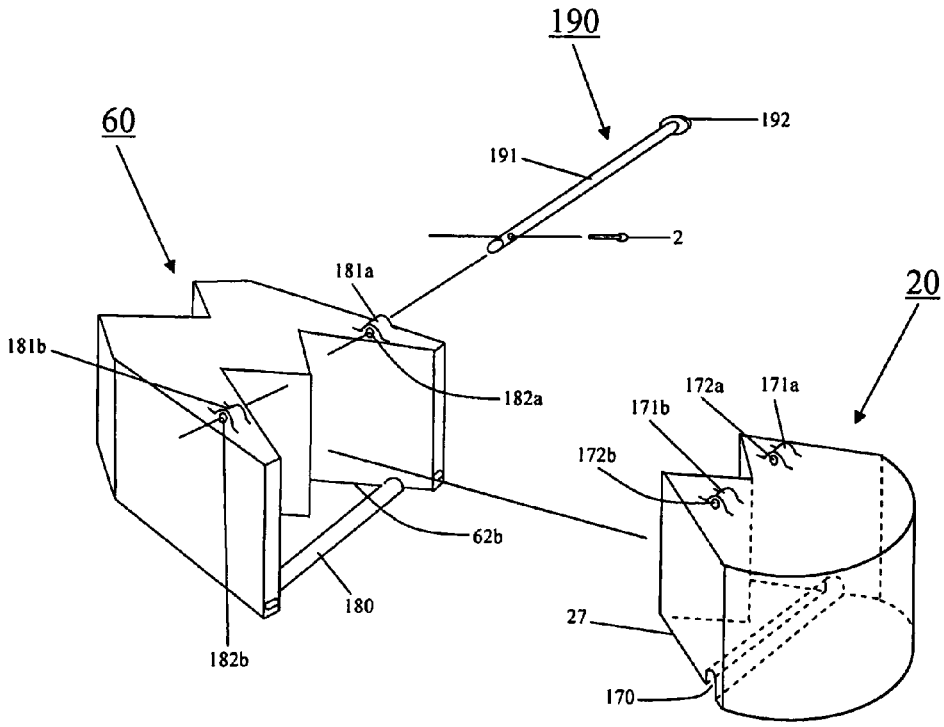
FIG. 12 is an exploded view of the training bag apparatus, constructed in accordance with the present invention, using the base of the speed bag assembly in conjunction with the base of the striking pad assembly.
Figure 13:
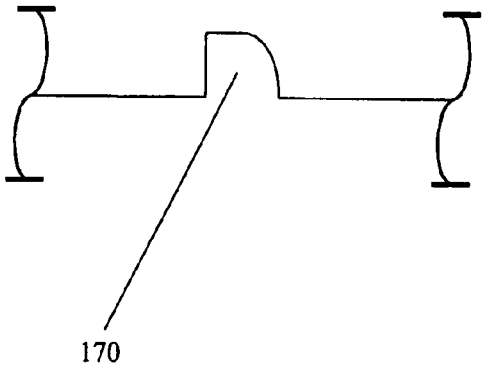
FIG. 13 is a sectional view of the furrow in the base of the striking pad assembly.
Figure 14:
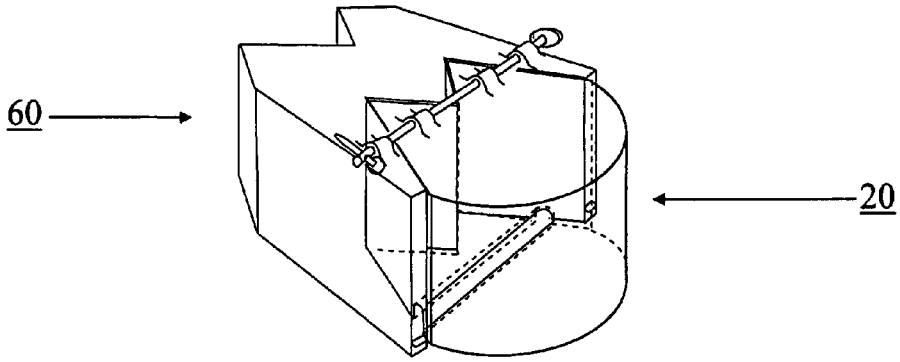
FIG. 14 is a perspective view of FIG. 12.
Figure 15:
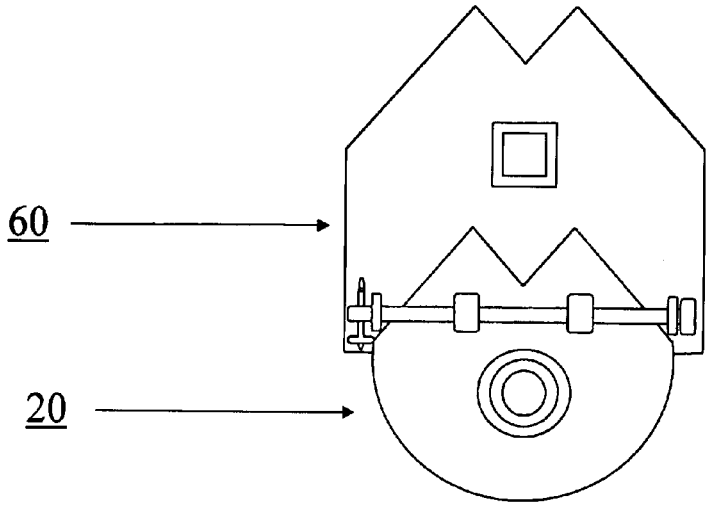
FIG. 15 is a top end view of the joined bases.
Figure 16:
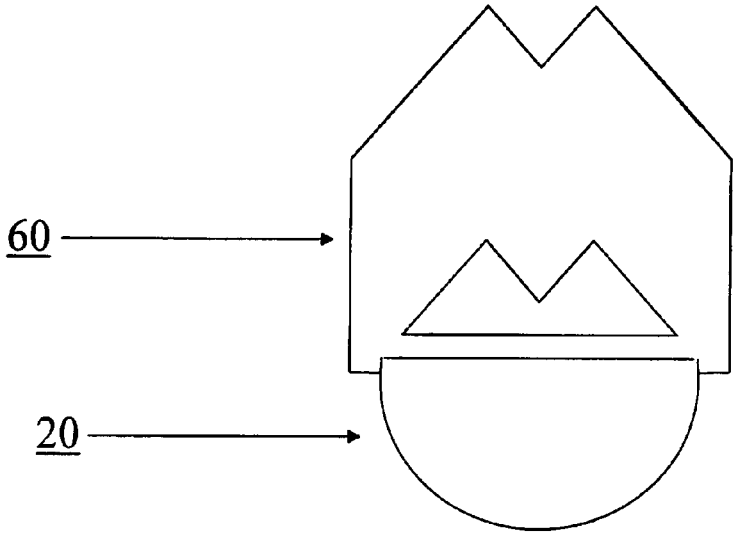
FIG. 16 is a bottom end view of the joined bases.

As best seen in FIGS. 8–11, a training bag apparatus in accordance with the present invention comprises a speed bag assembly 200, which includes a base 60 formed such that there exist angles 62*a* at its back end which allow it to conform to both the inner and outer corners of a wall, and angles 62*b* at its front which allow it to couple with the angles 27 of the base 20 of the striking pad assembly 10 (FIG. 2) to form a single unit (FIG. 1). The base 60 includes a chamber 61 formed therein for receiving fluids and including a mouth 66 formed in the upper portion thereof and communicating with the chamber 61 of the base 60 for receiving the fluids, such as the water, any suitable liquid, or other particulate materials, such as sand, gravel, coated or uncoated metallic shot and the like, to give the punching aid stability. A cap 4 is detachably secured onto the mouth 66 of the base 60 for enclosing the chamber 61 of the base 60 and for confining the fluids within the base 60. The base 60 includes a coupler 63, extended upward therefrom and having an aperture 64 formed therein for threading a fastener or a pin 2. The base 60 may also be made to a solid structure having a suitable stability. It should be appreciated that the base 60 may be constructed in a wide variety of geometric shapes without departing from the scope and purpose of the present invention. The right lower front portion of the base 60 includes a slot 65*a* formed therein for receiving a wheel attachment 610*a*. As best shown in FIG. 10, the wheel attachment 610*a* includes a bar 611*a* that is formed in such a way as to fit within the slot 65*a* of the base 60 while a brace 612*a* simultaneously rests against the bottom of the base 60 thus causing the wheel attachment to lock into place. The left lower front portion of the base 60 includes a slot 65*b* formed therein for receiving a wheel attachment 610*b*. As best shown in FIG. 10, the wheel attachment 610*b* includes a bar 611*b* that is formed in such a way as to fit within the slot 65*b* of the base 60 while a brace 612*b* simultaneously rests against the bottom of the base 60 thus causing the wheel attachment to lock into place.

Multiple hollow columns 70*a* and 70*b* are to be secured vertically on top of the base 60 for the purpose of support and height adjustments. Column 70*b* is formed in such a way as to fit into a hole 67 that is formed within the coupler 63 and base 60, column 70*b* is secured to coupler 63 via aperture 64 formed therein for threading a fastener or a pin 2. Column 70*a* fits into and is secured to column 70*b* via apertures 71 formed therein for threading a fastener or a pin 2.

A speed bag device 80 includes a speed bag platform 81 secured to the upper end of a support arm 82 whose lower end fits into column 70*a* and secured thereto along with a support brace 83 via apertures 72, 84 and 85 formed therein for threading a fastener or a pin.

As best seen in FIGS. 12–16, a base 20 includes a furrow 170 and posts 171*a* and 171*b*, furrow 170 is formed therein to be seated onto crossbar 180, post 171*a* includes an aperture 172*a* formed therein for threading a fastener or a rod 190, post 171*b* includes an aperture 172*b* formed therein for threading a fastener or a rod 190, a base 60 includes a crossbar 180 and posts 181*a* and 181*b*, post 181*a* includes an aperture 182*a* formed therein for threading a fastener or a rod 190, post 181*b* includes an aperture 182*b* formed therein for threading a fastener or a rod 190, a rod 190 includes shaft 191 with a knob 192 at one end and an aperture 193 formed therein for threading a fastener or pin 2. All these components are used in unison to join base 20 to base 60.

A base 20 is coupled with a base 60 in such a way that the angles 27 of base 10 fit flush into the angles 62*a* of base 60, this will cause the furrow of base 10 to rest on the crossbar 180 of base 60 while also aligning the apertures 182*a* of post 181*a*, 172*a* of post 171*a*, 172*b* of post 171*b*, and 182*b* of post 181*b* so that the shaft 191 of rod 190 can be threaded through all apertures 182*a* of post 181*a*, 172*a* of post 171*a*, 172*b* of post 171*b*, and 182*b* of post 181*b* until its knob 192 is stopped by post 181*a* which will place the aperture 193 of rod 190 on the outside of post 181*b* so that a fastener or pin 2 can be threaded through aperture 193 of rod 190 thus securing both base 10 and base 60 together, creating a single unit as best shown in FIG. 1. The threading of rod 190 is not limited to the fore-mentioned illustration but can also be applied in the opposite direction.

Figure 17:
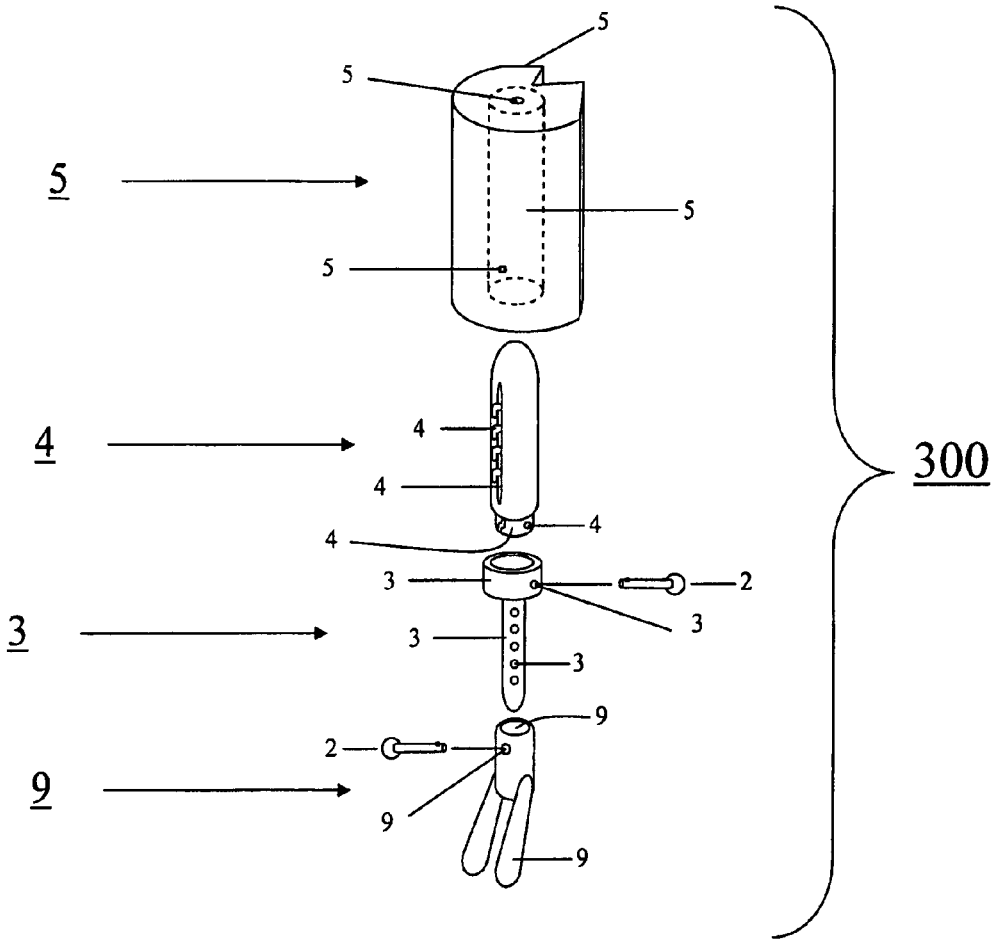
FIG. 17 is an exploded view of the training bag apparatus, constructed in accordance with the present invention, which is being used without the free standing base, but with stand that allows it to sit upright against a wall's inner or outer corner.
Figure 18:
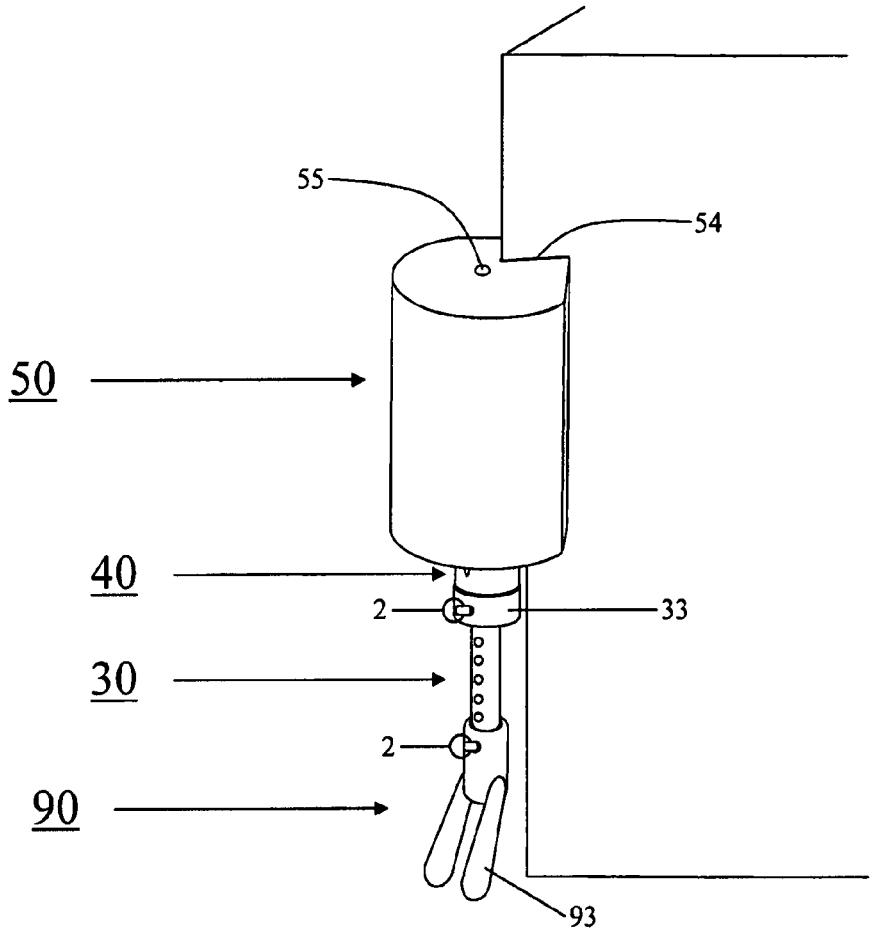
FIG. 18 is a perspective view of FIG. 17.

As best seen in FIGS. 17–18, a training bag apparatus in accordance with the present invention comprises a travel base application 300, which includes a hollow base 90 formed such that its lower end(s) 93 causes its load to press into whatever it is propped against. The base 90 includes an aperture 91 formed therein for threading a fastener or a pin 2.

A support unit 30 includes a coupler 33 and column 31 to be secured vertically on top of the base 90. The coupler 33 includes an aperture 34 formed therein for threading a fastener or a pin 2, such as a column 31 provided on the lower portion thereof, which includes apertures 32 formed therein for threading a fastener or a pin 2.

Figure 2:
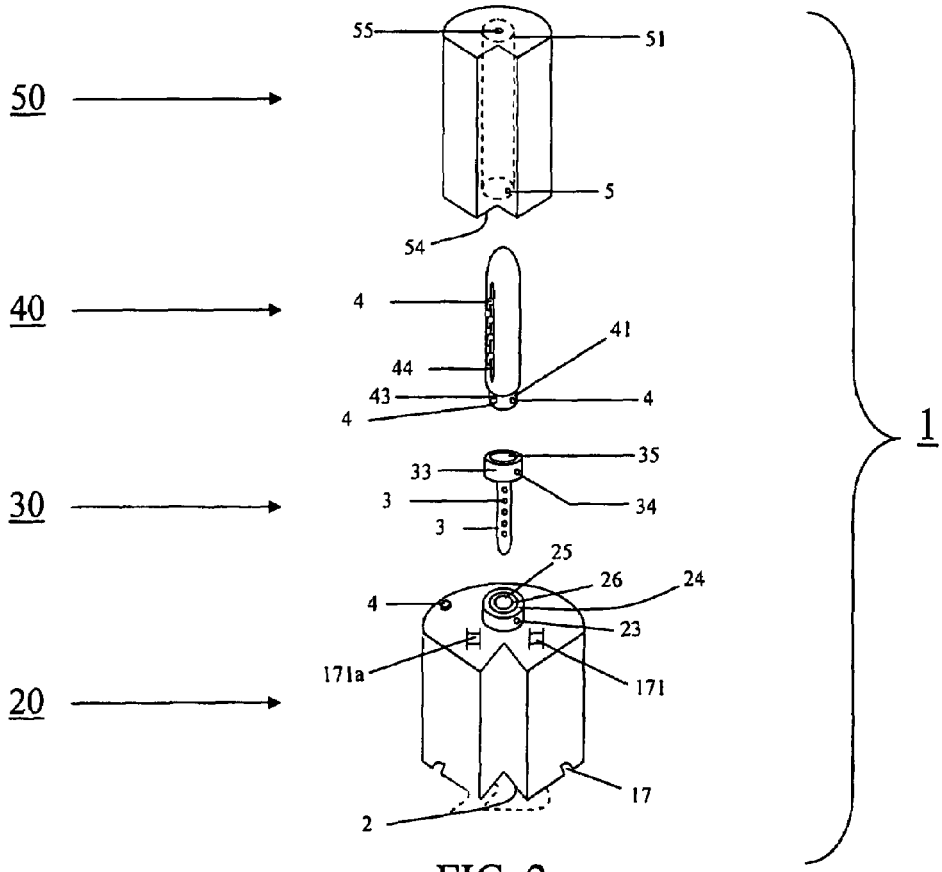
FIG. 2 is an exploded view of the striking pad assembly.
Figure 3:
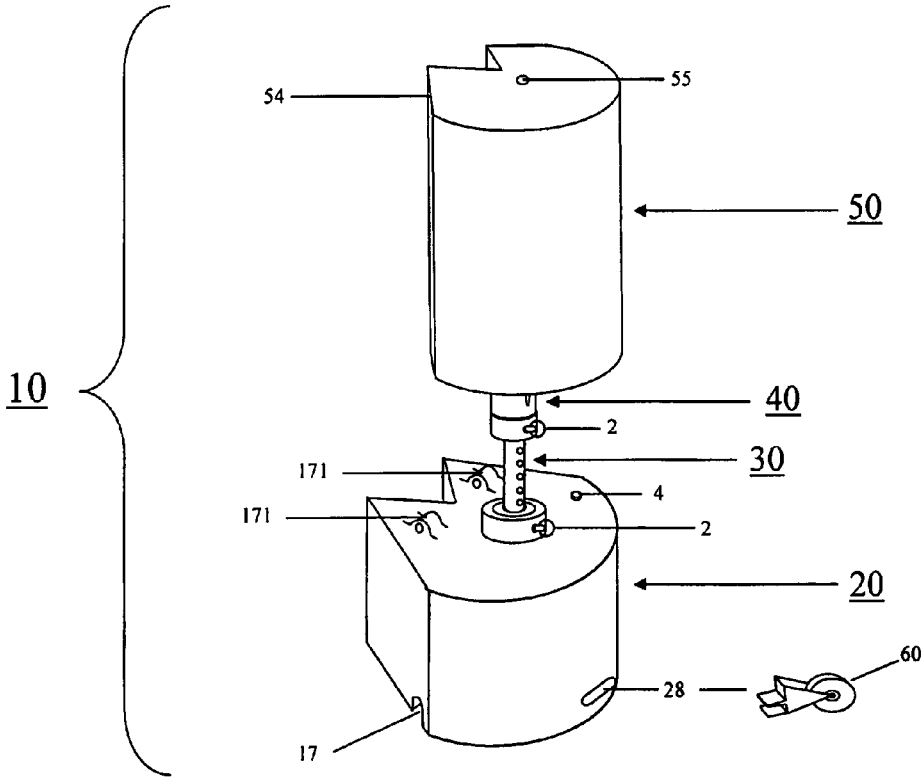
FIG. 3 is a perspective view of FIG. 2.
Figure 5:
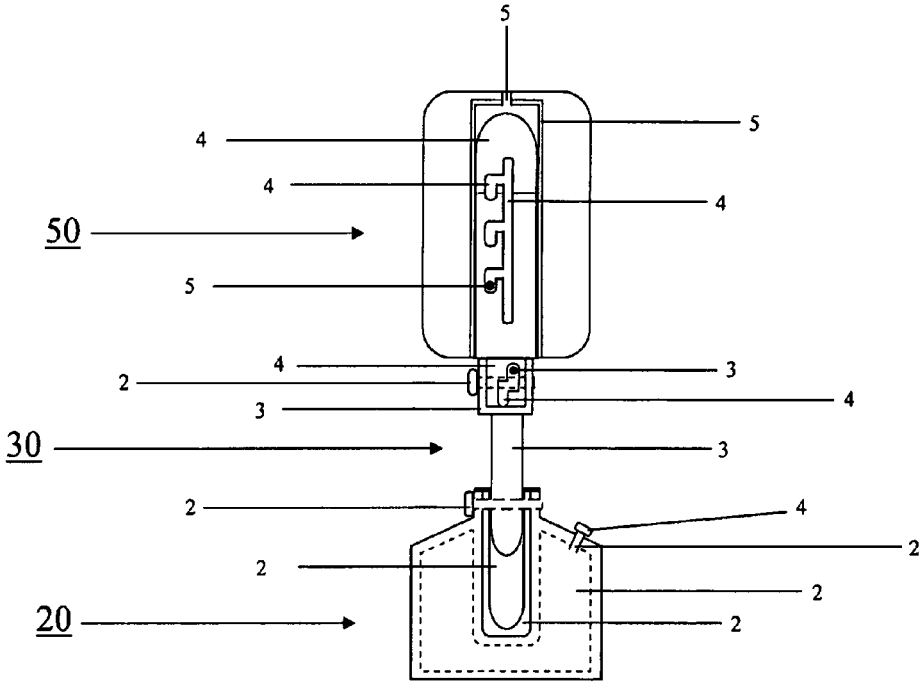
FIG. 5 is a sectional view of the striking pad assembly.
Figure 6:
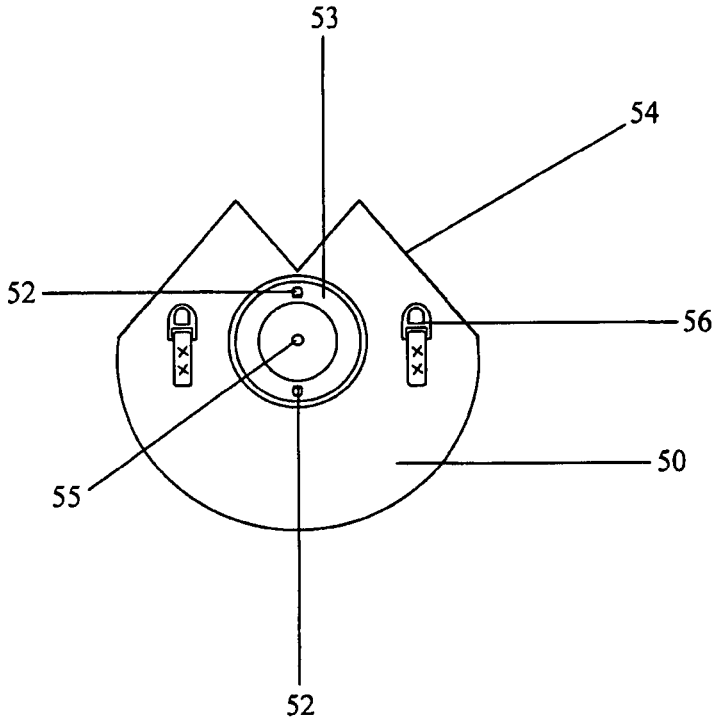
FIG. 6 is a bottom end view of the striking pad of the striking pad assembly.
Figure 7:
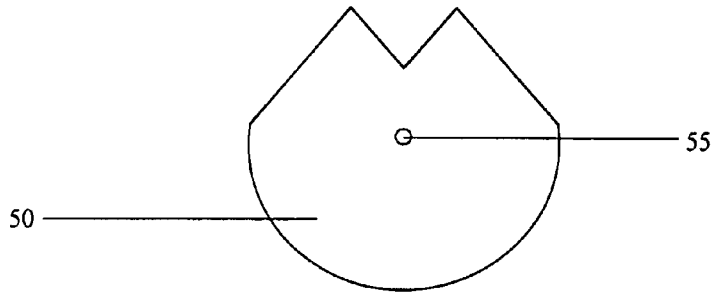
FIG. 7 is a top end view of the striking pad of the striking pad assembly.
Figure 8:
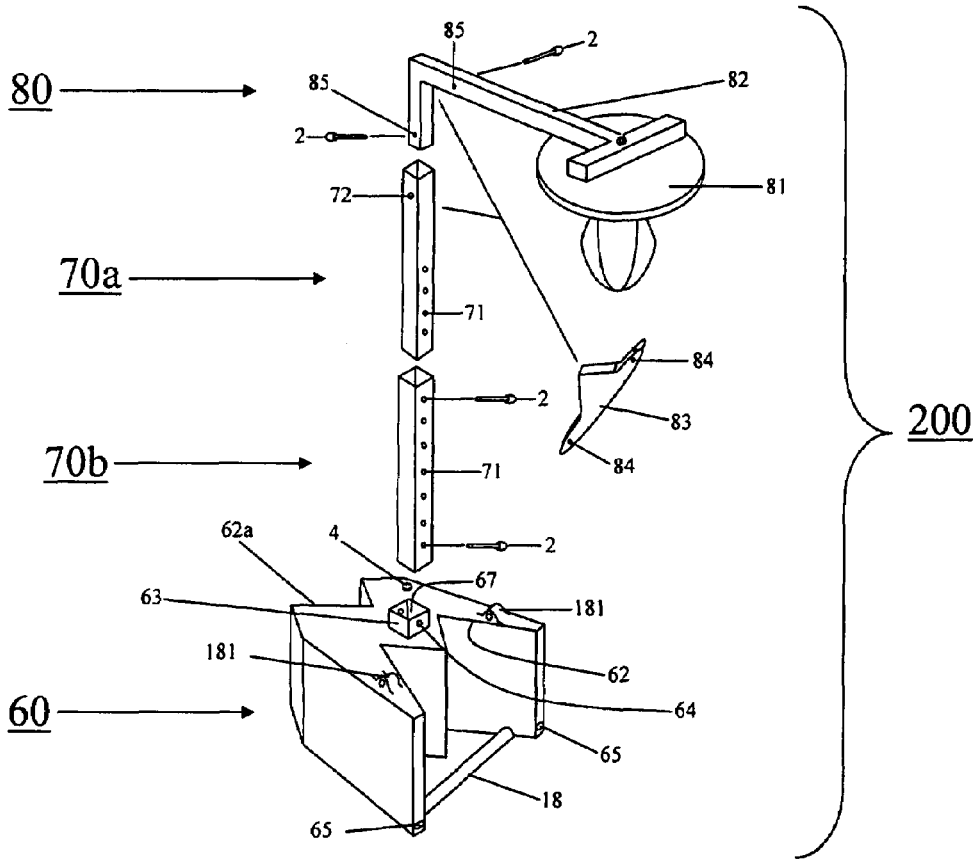
FIG. 8 is an exploded view of the speed bag assembly.
Figure 9:
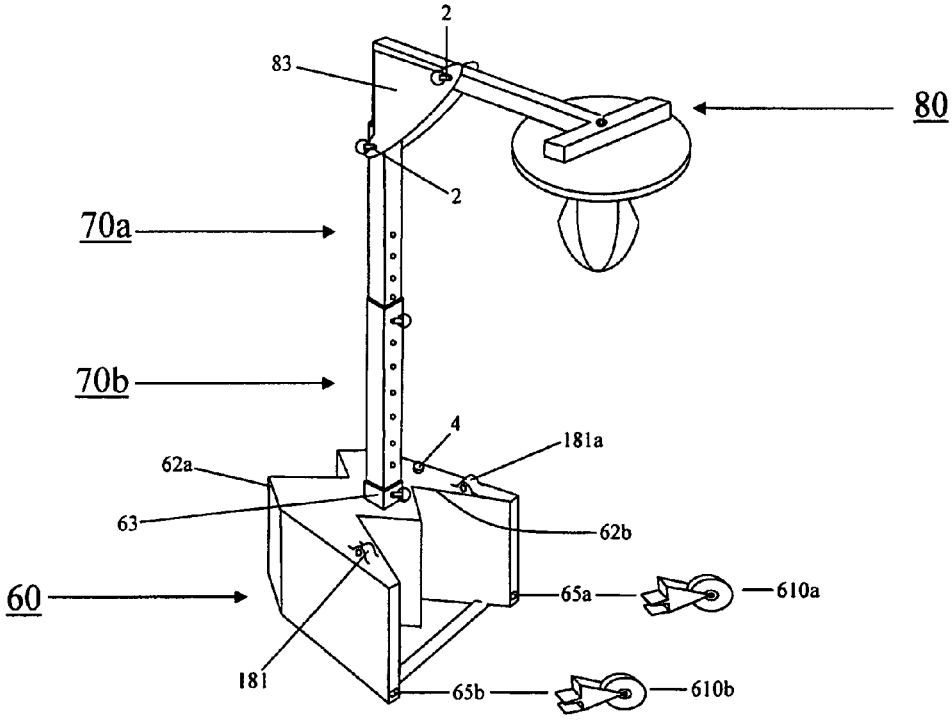
FIG. 9 is a perspective view of FIG. 8.

As best shown in FIGS. 2 and 5, a column 40 is to be secured vertically on top of the support unit 30 via a coupler 33, such as a stud 41 provided on the lower portion of the column 40. The stud 41 includes an aperture 47 formed therein for threading a fastener or a pin 2. The column 40 includes one or more longitudinal channels 44 formed therein and having one or more lock slots 45 communicating with the respective channels 44. As best shown in FIGS. 5–7, a striking pad 50 is formed to include angles 54 which allow it to conform to inner and outer angled wall corners, and includes a bore 51 formed therein for receiving the column 40 and includes one or more projections 52 extended inward of the bore 51 thereof for engaging into the channels 44 and/or the lock slots 45 of the column 40 and for setting the striking pad 50 to various heights.

Figure 19:
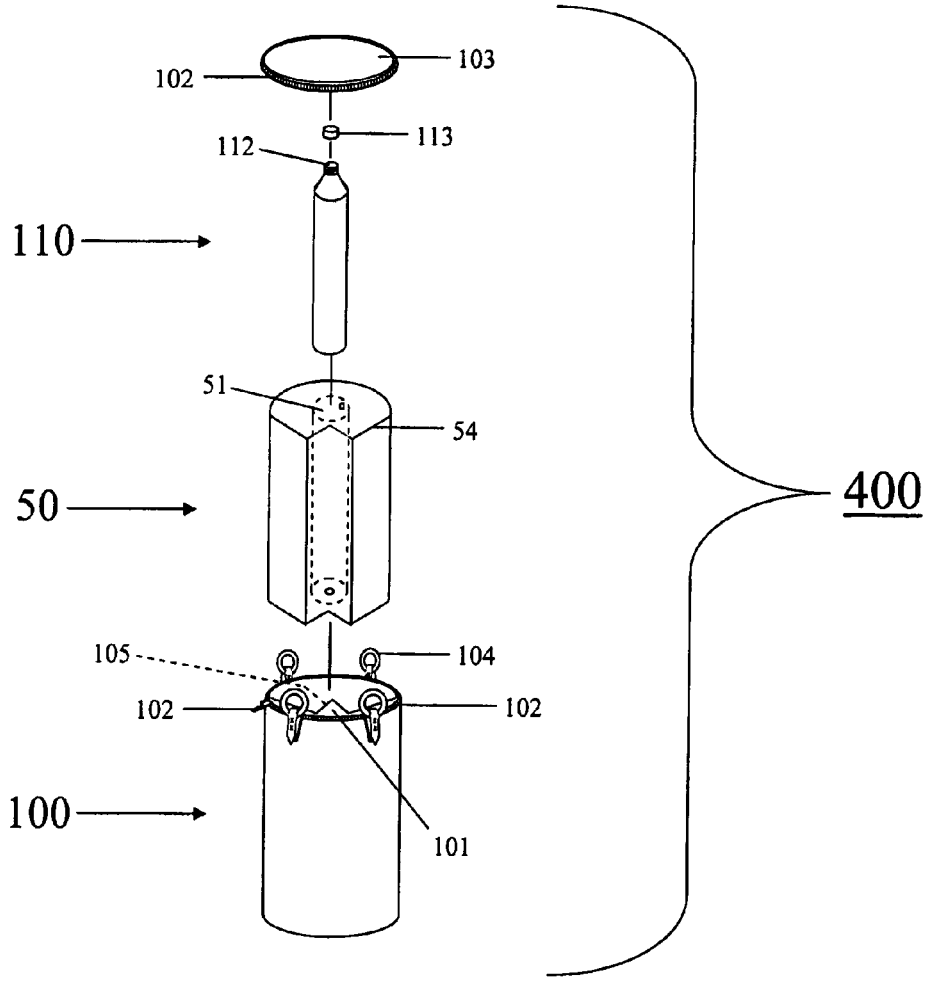
FIG. 19 is an exploded view of the training bag apparatus, constructed in accordance with the present invention, in which the striking pad is being used along with the heavy bag conversion slip cover, weighted insert, and several of the attachment means allowing it to be used as a heavy bag.
Figure 20:
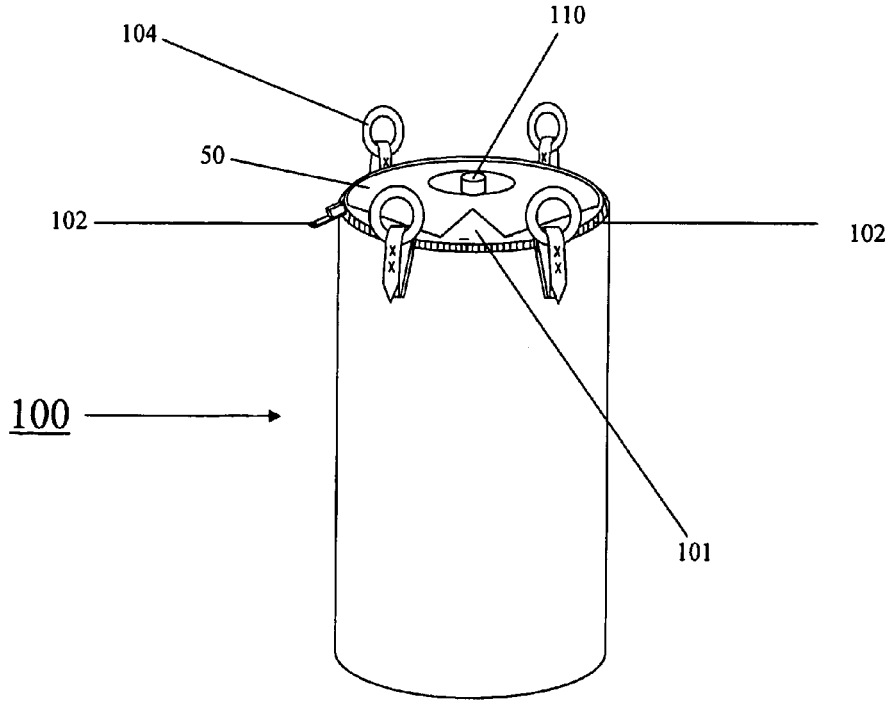
FIG. 20 is a perspective view of FIG. 19.

As best seen in FIGS. 19–20, a training bag apparatus in accordance with the present invention comprises a heavy bag conversion application 400, which includes a heavy bag 100 including a padded inner liner 101 that is formed such that it couples with the angles 54 of the striking pad 50 to form the completed circular striking surface that is indicative of a conventional hanging heavy "punching" bag. The heavy bag 100 includes hanging attachments 104 for hanging the bag via suitable means, and a zipper 102 for securing all necessary components within the heavy bag 100 via its top enclosure 103.

As best shown in FIG. 19, a striking pad 50 is inserted into the heavy bag 100 with the open end of its bore 51 facing upward. The angles 54 of the striking pad 50 are then aligned with the angles 105 of the inner liner 101 such that the angles 105 of the inner liner 101 communicate with the angles 54 of the striking pad 50 to form a completed circle.

A bag 110 is included for adjusting the weight of the heavy bag assembly 110 through the receiving of fluids, such as water, any suitable liquid, or other particulate materials, such as sand, gravel, coated or uncoated metallic shot and the like. The fluids are received through the mouth 112 of the bag 110. A cap 113 is detachably secured onto the mouth 112 of the bag 110 for confining the fluids within the bag 110. The bag 110 should be empty when inserted into the bore 51 of the striking pad 50, after which it can be filled to the desired weight with the desired suitable material.

Figure 21:
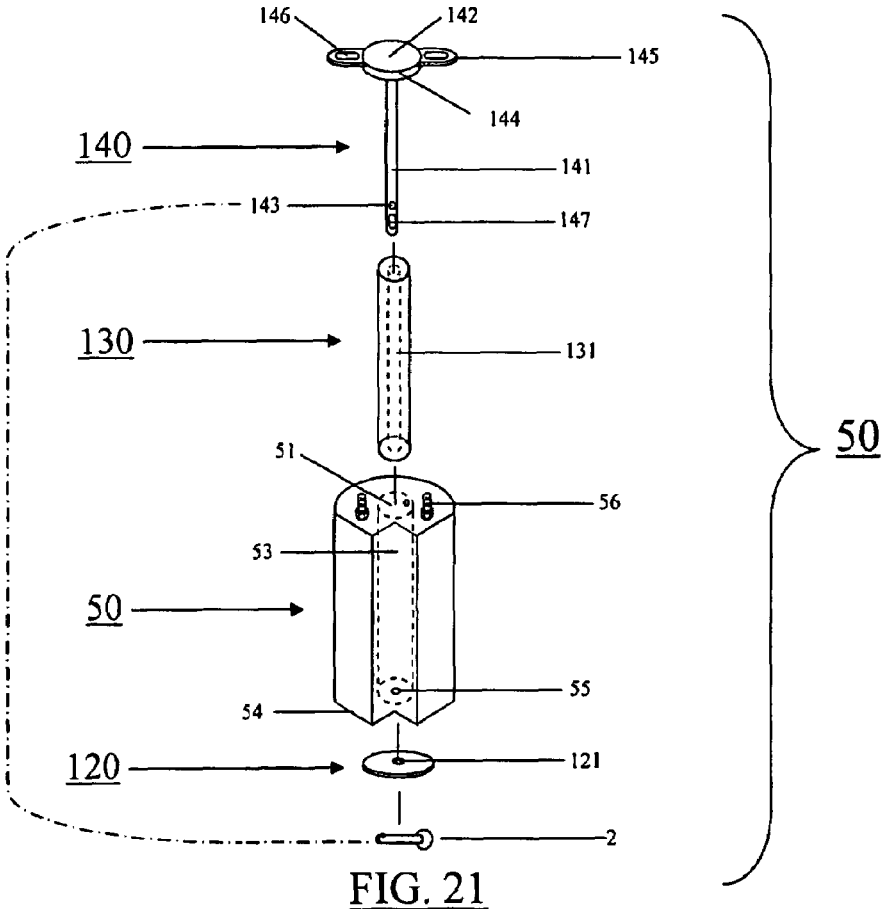
FIG. 21 is an exploded view of the training bag apparatus constructed in accordance with the present invention, in which it is prepared for use as a hand-held training aid.
Figure 22:
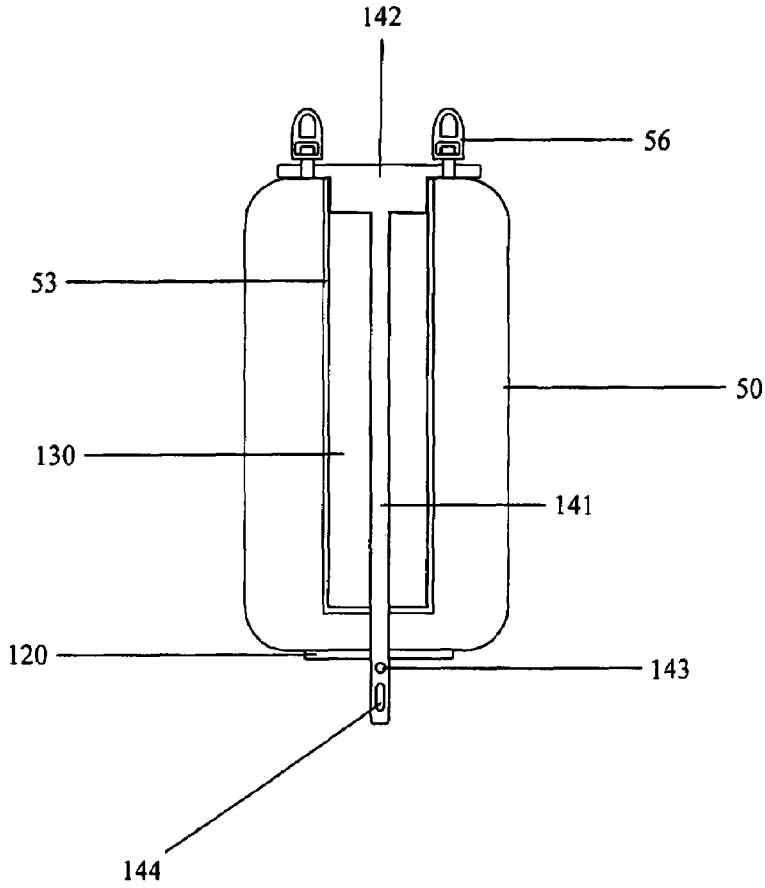
FIG. 22 is a sectional view of FIG. 21.
Figure 23:
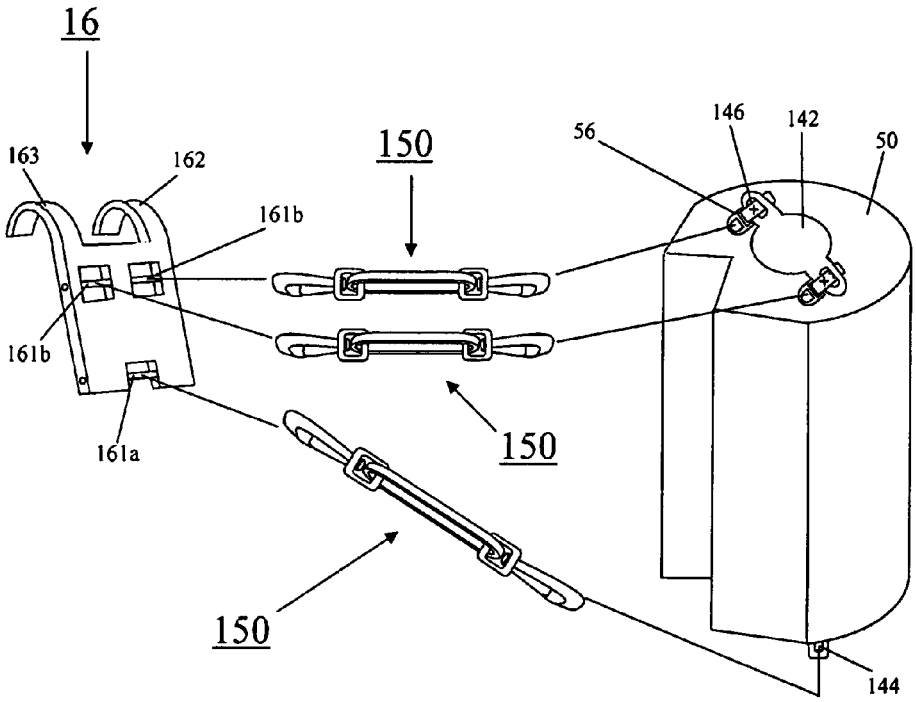
FIG. 23 is a perspective view of FIG. 21 and all necessary attachments.

Referring next to FIGS. 21–23, a training bag apparatus in accordance with the present invention comprises a handheld application 500, which includes a base support 120 with a hole at its center formed therein for threading the shaft 141 of the anchoring post 140. A striking pad 50 is used with the open end of its bore 51 facing upward to receive the center-cushion 130, the hole 55 of the striking pad 50 is formed therein for threading the shaft 141 of the anchoring post 140 as well as to allow air flow. A center-cushion 130 is preferably made of light weight spongy or rubber materials preferably stiffer and denser than all materials used to make the striking pad 50 for striking and support purposes, and is formed to include a bore 131 at its center which is formed therein for threading the shaft 141 of the anchoring post 140 and to align with the hole 55 of the striking pad 50, the center-cushion is shorter in length than the bore 51 of the striking pad 50 but the diameter of the center-cushion 130 is formed such that it completely fills the bore 51 of the striking pad 50. The center-cushion 130 is seated inside of the barrel 53 of the striking pad 50 via its bore 51. An anchoring post 140 includes a top 142 with two equally distanced opposing peripheral protrusions 145 each protrusion 145 contains an aperture 146 formed therein for threading the links 56 of the striking pad 50, the length of the bottom half 144 of the top 142 fills in the remaining length in the barrel 53 that was left unfilled by the center-cushion 130 that is seated inside of the barrel 53, the diameter of the bottom half 144 of the top 142 is formed such that it completely fills the bore 51 of the striking pad 50, the shaft 141 extends downward from the center of the bottom half 144 and contains two apertures near its end, aperture 143 is formed therein for threading a fastener or a pin 2, aperture 147 is formed therein for threading a fastener or a clasp 151, the shaft 141 of the anchoring post 140 is to be threaded through the bore 131 of the center-cushion 130 and the hole 55 of the striking pad 50 such that bottom half 144 of the top 142 is seated firmly atop of the center-cushion 130 within the bore 51 of the barrel 53 of the striking pad 50, the links 56 are to be threaded through their respective aperture 146 of the protrusion 145 of the anchoring post 140 which will allow the top 142 of the anchoring post 140 to fit flush against all related parts of the handheld application 500, at this point the support base 120 can be connected by threading the hole 121 of the support base 120 with the exposed end of the shaft 141 of the anchoring post 140 such that a fastener or pin 2 can be inserted through the aperture 143 of the shaft 141 thus locking the support base 120 to the striking pad 50 and securing the anchoring post 140 in place.

The "user" that will be mentioned in the following paragraph is referring to a trainer that will hold and manipulate the invention while another person strikes it.

An adjustable strap 150*a*, adjustable straps 150*b*, and a body brace 160 are used to secure the handheld application 500 to its user. Adjustable straps 150*b* are secured to their respective link 56 of the striking pad 50 of the hand-held application 500 via a swiveling clasp 151 located at either end of each adjustable strap 150*b*, adjustable strap 150*a* is secured to aperture 147 of the anchoring post 140 of the handheld application 500, each remaining unsecured swiveling clasp 151 of the adjustable straps 150*b* can now be secured to its respective anchoring point 161*b* of the body brace 160, the unsecured end of adjustable strap 150*a* can now be secured via its swiveling clasp 151 to anchoring point 161*a* of the body brace 160, at this point the body brace 160 is worn by the user via its shoulder supports 162 and 163, shoulder support 162 fits over the left shoulder of the user while shoulder support 163 fits over the user's right shoulder. At this point the body brace 160 will rest against the front of the users and on both shoulders, which helps to balance the weight (although extremely light) of the handheld application 500 evenly throughout the body of the user, such that the user may move freely about with the handheld application, using it as a moving target or opposing training aid from which the user will be able to see over the top of to observe and critique the technique of the person striking the handheld application 500.

Accordingly, the punching aid in accordance with the present invention includes a flexible structure for facilitating the punching or boxing exercises, and includes a detachable structure for allowing the punching aid to be disassembled and packaged to a compact configuration. It has thus been seen that a new and novel punching and kicking aid has been illustrated and described, and although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A multifunction multi-conversion striking apparatus usable as a combination speed bag and/or striking apparatus with the ability to fit against the inner or outer corner of a wall comprising:

multiple bases with multiple inner cavities and mounting means on their periphery that permit the attachment and detachment of wheel assemblies;

means for securing said multiple bases together, said securing means include upper and lower interlocking cross-members;

multiple removable columns upon said bases;

wherein said columns adjust in the vertical position and the bottom most columns have a point of origin that starts from within said bases from which they then extend vertically upward;

a speed bag assembly attached onto one of said multiple columns:

a striking pad assembly attached onto one of said multiple columns:

multiple striking pad assemblies;

wherein said striking pad assemblies comprise means for a heavy bag conversion for use as a traditional hanging heavy punching bag, means for a portable conversion for easy travel use against the inner or outer corner of an available wall or suitable brace, and means for a hand-held conversion that allows one person to hold said striking pad as a moving target while a separate person strikes said pad.

* * * * *